US008988414B2

(12) United States Patent
Lee

(10) Patent No.: US 8,988,414 B2
(45) Date of Patent: Mar. 24, 2015

(54) FLAT PANEL DISPLAY AND DRIVING CIRCUIT THEREOF

(71) Applicant: HyunSuk Lee, Gyeonggi-do (KR)

(72) Inventor: HyunSuk Lee, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 79 days.

(21) Appl. No.: 13/650,478

(22) Filed: Oct. 12, 2012

(65) Prior Publication Data

US 2013/0093749 A1 Apr. 18, 2013

(30) Foreign Application Priority Data

Oct. 13, 2011 (KR) ..... 10-2011-0104821

(51) Int. Cl.
*G09G 5/00* (2006.01)
*G09G 3/20* (2006.01)
*G09G 3/32* (2006.01)

(52) U.S. Cl.
CPC ... *G09G 3/20* (2013.01); *G09G 3/32* (2013.01)
USPC ..... 345/212

(58) Field of Classification Search
CPC ..... G09G 2330/00; G09G 2330/02; G09G 2330/021; G09G 2330/028; G09G 3/20; G09G 3/32
USPC ..... 345/211, 212
See application file for complete search history.

(56) References Cited

U.S. PATENT DOCUMENTS

| | | | | |
|---|---|---|---|---|
| 8,508,454 | B2 * | 8/2013 | Chang et al. | 345/98 |
| 2004/0264268 | A1 | 12/2004 | Fukumoto | |
| 2005/0013064 | A1 * | 1/2005 | Van Dalfsen et al. | 361/18 |
| 2008/0001895 | A1 * | 1/2008 | Choi | 345/98 |
| 2009/0085676 | A1 | 4/2009 | Nishiyama et al. | |
| 2011/0141097 | A1 * | 6/2011 | Lee et al. | 345/212 |

FOREIGN PATENT DOCUMENTS

| | | | |
|---|---|---|---|
| CN | 1783166 | A | 6/2006 |
| CN | 102081915 | A | 6/2011 |
| DE | 10 2005 002 787 | A1 | 11/2005 |
| EP | 0 347 194 | A2 | 12/1989 |
| EP | 2 086 097 | A2 | 8/2009 |
| JP | 2005-321760 | A | 11/2005 |
| KR | 10-0572564 | B1 | 4/2006 |
| KR | 10-2007-01163 73 | A | 12/2007 |
| KR | 10-2010-0037926 | A | 4/2010 |
| TW | 260341 | A | 5/1998 |
| TW | 201117215 | A | 5/2011 |

OTHER PUBLICATIONS

Korean Intellectual Property Office, Office Action, Korean Patent Application No. 10-2011-0104821, Mar. 24, 2014, five pages [with concise explanation of relevance].
State Intellectual Property Office, Office Action, Chinese Patent Application No. 201210385413.7, Jul. 10, 2014, 17 pages.
Korean Intellectual Property Office, Notice of Allowance, Korean Patent Application No. 10-2011-0104821, Sep. 26, 2014, 3 pages.
Taiwan First Office Action, Taiwan Application No. 101136255, Sep. 24, 2014, 8 pages.
German Patent Office, Office Action, German Patent Application No. 102012109470.5, Dec. 22, 2014, fifteen pages.

* cited by examiner

*Primary Examiner* — Tom Sheng
(74) *Attorney, Agent, or Firm* — Fenwick & West LLP

(57) ABSTRACT

The present invention relates to increasing the driving reliability of a flat panel display by including a protector in the power supply control unit that provides a driving voltage to the display panel. The protector prevents unexpected sequence mode transition of the memory by preventing transmission of an abnormal voltage caused by applied stress while providing a supplied voltage to the memory during normal driving.

9 Claims, 4 Drawing Sheets

FLAT PANEL DISPLAY AND DRIVING CIRCUIT THEREOF

This application claims priority to Korean Patent Application No. 10-2011-0104821, filed on Oct. 13, 2011, which is incorporated by reference herein in its entirety.

BACKGROUND OF THE INVENTION

1. Field of the Invention

The present disclosure relates to a flat panel display, and particularly, to storing data related to a driving voltage for driving a display panel, and a driving circuit thereof.

2. Background of the Invention

A flat panel display (FPD) is a display device which replaces a conventional cathode ray tube (CRT) display and is essentially used to implement a small-sized and light-weight system, such as a notebook computer, personal digital assistant (PDA), portable phone, and the like, as well as large-format systems such as a display monitor of a desktop computer and televisions. Current commercially available flat panel displays include a liquid crystal display LCD, a plasma display panel (PDP), an organic light emitting diode (OLED) display, and so on.

FIG. 1 is a view showing an example of a single pixel in the organic light emitting diode display among the above-mentioned flat panel displays. The display may include a plurality of scan lines SL and a plurality of data lines DL arranged in rows and columns that intersect at a plurality of pixels.

As shown, the pixel in FIG. 1 includes an organic light emitting diode D1, a switching thin film transistor ST and a driving thin film transistor DT, and is disposed in a region including a scan line SL supplying a scan signal, a data line DL supplying a data signal, and a driving voltage VDDEL supply.

A gate of the switching thin film transistor ST is connected to the scan line SL, a source thereof is connected to a gate of the driving thin film transistor DT, and a drain thereof is connected to the data line DL and functions as a switching element.

The gate of the driving thin film transistor DT is connected to the source of the switching thin film transistor ST and one end of a capacitor Cst, the source thereof is connected to the driving voltage VDDEL, and the drain thereof is connected to an anode of the organic light emitting diode D1. The driving thin film transistor DT functions as a driving element of the organic light emitting diode D1 by providing a driving current $I_{OLED}$ according to the voltage at its gate.

While the switching and driving thin film transistors ST and DT are depicted as PMOS transistors in FIG. 1, they may alternatively be formed as NMOS transistors.

One side of the capacitor Cst is connected to the source of the switching thin film transistor ST and the gate of the driving thin film transistor DT, and the other side thereof is connected to the driving voltage VDDEL.

The anode of the organic light emitting diode D1 is connected to the drain of the driving thin film transistor DT, and a cathode thereof is connected to a ground voltage VSS. An organic emission layer is provided between the anode and the cathode. The organic emission layer may include, for example, a hole injection layer, a hole transporting layer, an emission layer, an electron transporting layer, and an electron injection layer. Also, the organic emission layer may include, for example, an electron injection layer, an electron transporting layer, an emission layer, a hole transporting layer, and a hole injection layer.

The driving voltage VDDEL supplied to the pixel in the organic light emitting diode display having the above-mentioned structure may be set differently depending on a display panel; however, it is typically tightly regulated to a stable voltage level, for example, at 8.75 V. To this end, the flat panel display includes a power supply control unit for controlling the generation and supply of voltages used by the flat panel display in accordance with a power-up sequence based on preset data.

In particular, under the current trend towards highly integrated ICs and increasing complexity of driving, data required for a power-up sequence is stored in a memory, i.e., EEPROM (Electrical Erasable Programmable ROM). Accordingly, when the flat panel display is powered on, the data stored in the address of the EEPROM is read and the driving voltage VDDEL of the display panel is generated.

FIG. 2 is an equivalent circuit diagram showing an example of a internal structure of an EEPROM used for a conventional organic light emitting diode display.

As shown, the conventional EEPROM includes a first transistor T1 whose source is connected to a first input terminal connected to an external controller (not shown), whose gate is connected to a second resistor R2, and whose drain is connected to an output terminal, and a second transistor T2 whose source is connected to a second input terminal connected to the external controller, whose gate is connected to a first resistor R1, and whose drain is connected to the output terminal.

Although not shown, the above-mentioned output terminal is connected to a data storage cell in the EEPROM, and performs read, write, and erase operations on predetermined data by an output voltage.

The driving of the EEPROM with this structure will be explained. When a high-level driving enable signal VPP_HIGH is applied to the second input terminal, and a specific sequence signal, e.g., data write signal XWRITEB, is applied, the first and second transistors T1 and T2 become conductive. Accordingly, the data write signal XWRITEB is provided by a driving output voltage EXVPP to the data cell in the EEPROM through the output terminal, thereby performing read, write, and erase operations on data.

In accordance with the above-described operation, the system configurator configures a flat panel display by storing desired data in the EEPROM, then bonding other driving ICs of the flat panel display together onto a substrate by a typical SMT process, and then connecting the substrate to the display panel.

The above-mentioned SMT process is a process which applies considerable stress to each of the driving ICs; stress is applied even to each pin of the EEPROM. Especially, if stress is applied to a pin corresponding to an input terminal of the above-mentioned data write signal XWRITEB, a parasitic diode is formed between the above-mentioned first transistor T1 and the output terminal, and a predetermined current flows. Thus, the EEPOROM switches to erase mode even if the corresponding sequence is not input, and therefore data erasure may occur.

Accordingly, the driving voltage VDDEL provided to the display panel is output not at the preset voltage level (e.g., 8.75V) but at an arbitrary voltage level (e.g., up to 14V), thereby leading to malfunctioning of the display panel.

SUMMARY OF THE INVENTION

Embodiments herein provide a driving circuit of a flat panel display such as an organic light emitting diode display that prevents data erasure due to external stress in a memory storing data related to a driving voltage of a display panel.

The driving circuit embodiments disclosed herein increase the driving reliability of a flat panel display by including a protector in the power supply control unit that provides a driving voltage to the display panel. The protector prevents unexpected sequence mode transition of the memory by preventing transmission of an abnormal voltage caused by applied stress while providing the supply voltage to the memory during normal driving.

In one embodiment, a driving circuit of a flat panel display includes: a memory that operates in first and second sequence modes, and is set to the second sequence mode as at least one of control terminals for selecting a sequence mode is grounded and outputs data corresponding to a driving voltage; a controller whose output terminal is connected to the control terminal, and which determines the sequence mode of the memory; and a protector that is electrically connected to the output terminal and the control terminal, and prevents the memory from malfunctioning in the first sequence mode as an abnormal voltage is applied to the control terminal.

The first sequence mode is a data erase mode of the memory.

The second sequence mode is one selected from the group consisting of the standby mode, data read mode, and data write mode of the memory.

The protector includes a first switching element whose source is connected to the output terminal, and whose drain is connected to the control terminal; a second switching element whose source is connected to the first switching element, whose gate is connected to an operation control signal terminal of the controller, and whose drain is grounded; a first resistor whose ends are respectively connected to the source and gate of the first switching element; a second resistor whose ends are respectively connected to the source and gate of the second switching element; and a pull-down resistor connected between the output terminal and the ground terminal.

The first and second switching elements are a PMOS transistor and an NMOS transistor, respectively.

The protector further includes a zener diode that is connected in parallel to the first switching element, and whose breakdown voltage is greater than the abnormal voltage.

The abnormal voltage is a voltage generated by stress applied to the memory during an SMT process.

The driving voltage corresponds to a voltage for driving an organic light emitting diode.

The memory is an EEPROM.

In another embodiment, a flat panel display includes a display panel including a plurality of organic light emitting diodes; a driving control unit controlling the display panel; and a power supply control unit that includes a memory storing data about the driving voltage of the organic light emitting diodes and a protector for preventing data erasure caused by malfunctioning of the memory under the control of the driving control unit.

The flat panel display according to the embodiment herein can increase the driving reliability of the flat panel display because it includes a protector in the power supply control unit providing a driving voltage to the display panel and prevents unexpected sequence mode transition of the memory by providing a corresponding voltage to the memory during normal driving and preventing an abnormal voltage caused by applied stress.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF EMBODIMENTS

Hereinafter, a driving circuit of a flat panel display according to a preferred embodiment of the present invention will be described below with reference to the drawings.

Figure 3:
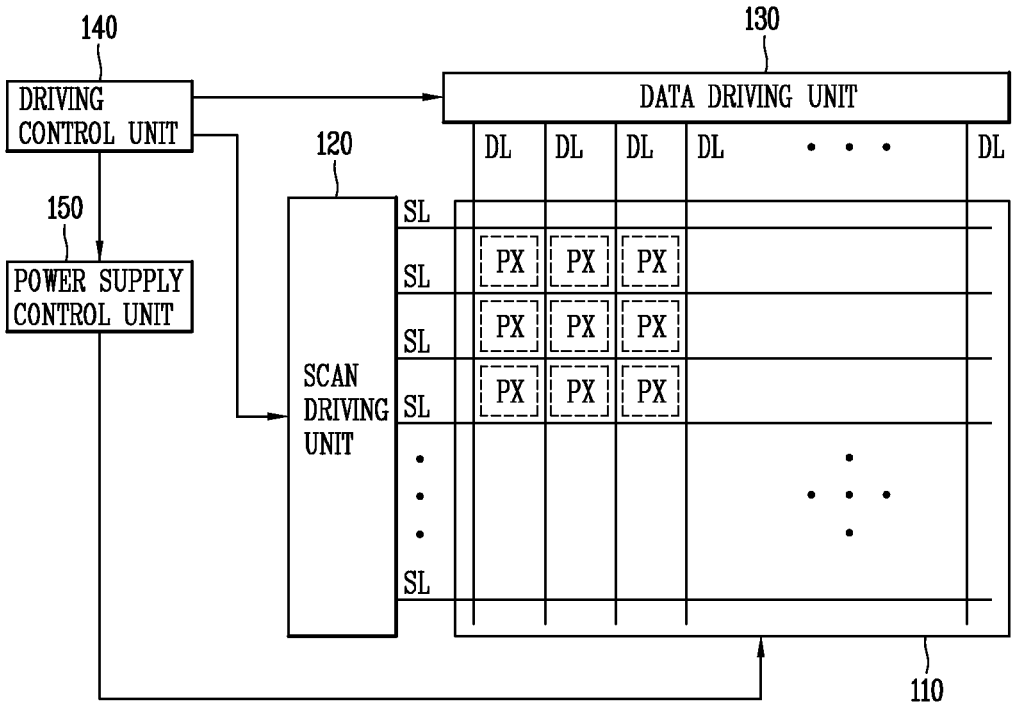
FIG. 3 is a view showing an overall structure of a flat panel display including a driving circuit according to an embodiment of the present invention.

FIG. 3 is a view showing an overall structure of a flat panel display including a driving circuit according to an embodiment of the present invention.

The flat panel display, which may be an organic light emitting diode display, comprises a display panel 110, a scan and data driving units 120 and 130 for driving the display panel 110, a driving control unit 140 for controlling the drivers 120 and 130, and a power supply control unit 150 for providing a driving voltage to the display panel 110.

As shown, the display panel 110 comprises a plurality of signal lines SL and data lines DL arranged in a matrix form and defining a plurality regions where the pixels PX of the display panel 110 are disposed from an equivalent circuital view. The scan lines SL are formed in rows and disposed parallel to each other to supply scan signals to corresponding rows of pixels PX, and the data lines DL are formed in columns and disposed perpendicular to the scan lines SL and parallel to each other to supply data signals to corresponding columns of pixels PX.

Figure 1:
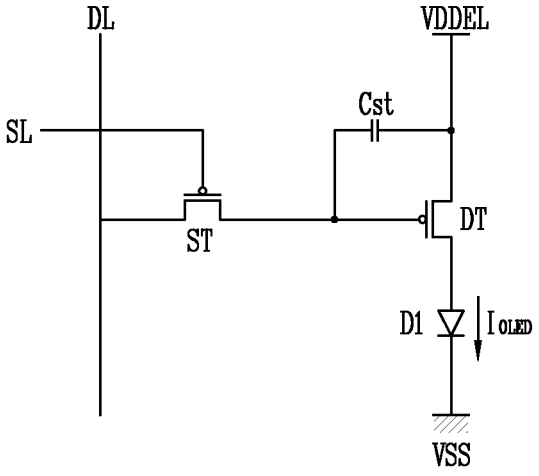
FIG. 1 RELATED ART
FIG. 1 is a view showing an example of a single pixel constituting the organic light emitting diode display among the above-mentioned flat panel displays.
Figure 2:
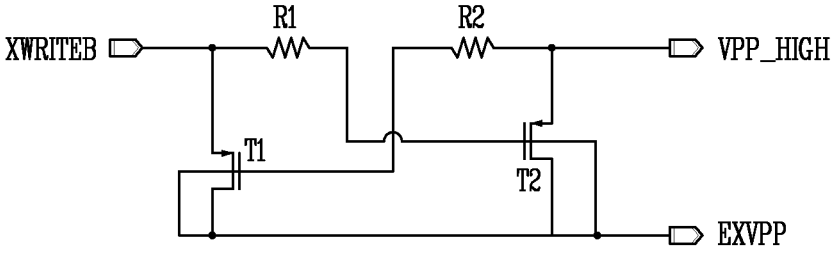
FIG. 2 RELATED ART
FIG. 2 is an equivalent circuit diagram showing an example of a internal structure of an EEPROM used for a conventional organic light emitting diode display.

Each pixel PX may have the same structure as a conventional organic light emitting diode display, and referring to FIG. 1, may comprise an organic light emitting diode D1, capacitor Cst, a switching thin film transistor ST and a driving thin film transistor DT.

A gate of the switching thin film transistor ST is connected to the scan line SL, a source thereof is connected to a gate of the driving thin film transistor DT, and a drain thereof is connected to the data line DL and functions as a switching element.

The gate of the driving thin film transistor DT is connected to the source of the switching thin film transistor ST and one end of a capacitor Cst, the source thereof is connected to a driving voltage VDDEL, and the drain thereof is connected to an anode of the organic light emitting diode D1 and functions as a driving element for driving the organic light emitting diode D1.

An operation of the pixel PX having the above-described structure will now be described. The switching thin film transistor ST is turned on by the scan signal supplied to the scan line SL, and the data signal supplied to the data line DL charges the capacitor Cst to a differential voltage between the driving voltage VDDEL and the data signal. In turn, the driving thin film transistor DT receives the differential voltage at its gate, thereby conducting current to drive the organic light emitting diode D1. The driving thin film transistor DT supplies a driving current $I_{OLED}$ resulting from the magnitude of the differential voltage across the capacitor Cst, and the organic light emitting diode D1 displays a gray level (e.g., emits an amount of light) which is proportional to the driving current IOLED.

Referring again to FIG. 3, the scan driving unit 120 is connected to the scan lines SL of the display panel 110, and applies scan signals formed of a combination of a scan ON voltage and a scan OFF voltage, which are externally provided. The scan driving unit 120 may be formed together on the display panel 110 during a thin film transistor forming process.

The data driving unit 130 is connected to the data lines DL of the display panel 110, and includes a plurality of integrated circuits that generate a plurality of gray level signals based on a plurality of reference voltages provided from a reference signal generator (not shown), select a generated gray level signal for each pixel PX in the display 110, and apply the generated gray level signals though the data lines DL at each pixel as a data signal.

The driving control unit 140 controls the drivers by generating a plurality of control signals for controlling operations of the scan driving unit 120, data driving unit 130, etc and providing a corresponding control signal to the scan driving unit 120 and the data driving unit 130.

Moreover, the driving control unit 140 provides an enable signal EN to the power supply control unit 150 to be described later, and controls the power supply control unit 150 to generate the driving voltage VDDEL of the display panel 110.

The power supply control unit 150 receives the enable signal EN from the driving control unit 140, and outputs a driving voltage VDDEL at the driving transistor (DT of FIG. 1) of each pixel. At this point, the power supply control unit 150 outputs a driving voltage VDDEL having a constant level regardless of external changes. This driving voltage VDDEL is applied to the driving transistor DT of each pixel of the display panel 110 to allow the screen of the display panel 110 have a given brightness. Therefore, it is possible to implement an organic light emitting diode display having a high-quality screen.

To generate the above-mentioned driving voltage VDDEL, multiple data, including switching frequency data, output voltage level data, feedback voltage control data, and soft start timing control data, may be received and stored in a memory to be described later.

Although not shown, the power supply control unit 150 may generate a plurality of driving voltages for driving the flat panel display, as well as the above-mentioned driving voltage VDDEL. In an example, the power supply control unit 150 may be configured to generate a scan ON voltage Von, a scan OFF voltage Voff, etc.

To this end, the power supply control unit 150 includes a memory with data about the level of a driving voltage set therein, a controller for determining and controlling the sequence mode of the memory, and a protector that is electrically connected to an input terminal involved in data erasure, and prevents the phenomenon that stored data is erased because the memory malfunctions in the sequence mode as an abnormal voltage caused by externally applied stress, among sequence voltages applied from the controller to the memory, is applied.

A more detailed description of the structure of the power supply control unit 150 will be described later.

With the above-described structure, data related to a driving voltage provided to the display panel of a completed flat panel display may be stably stored in the memory, and therefore a constant driving voltage may be provided to the display panel upon driving of the light emitting elements of the flat panel display, thereby increasing the driving reliability of the flat panel display.

Hereinafter, the structure of the power supply control unit, which is the driving circuit of the flat panel display according to an embodiment of the present invention, will be described in more detail below with reference to the drawings.

Figure 4:
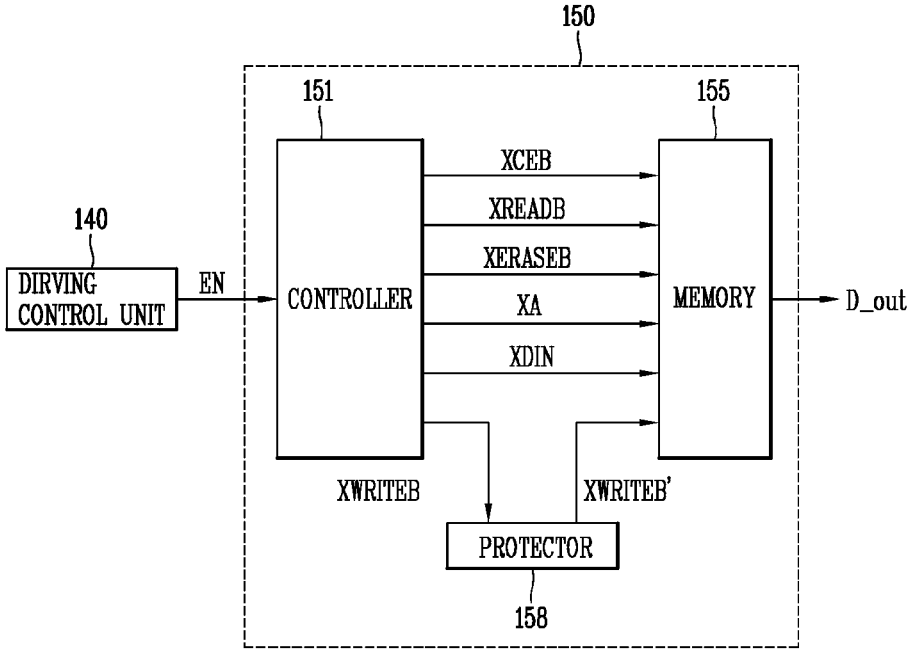
FIG. 4 is a view showing a driving circuit of a flat panel display according to an embodiment of the present invention.

FIG. 4 is a view showing a driving circuit of a flat panel display according to an embodiment of the present invention.

As shown therein, the driving circuit of the flat panel display includes a power supply control unit 150 that provides a driving voltage to the display panel in response to a signal applied from the driving control unit 140. The power supply control unit 150 includes a controller 151 for applying a plurality of sequence voltages to a memory 155 to determine the sequence mode of the memory and reading, writing, and erasing data, the memory 155 for storing data related to the driving voltage, and a protector 158 connected to an output terminal of the controller 151 and an input terminal of the memory 155 attached to the output terminal to allow an abnormal driving voltage to pass, and preventing an abnormal voltage caused by stress.

More specifically, the controller 151 generates a plurality of sequence signals for controlling the sequence mode of the memory in response to an enable signal EN, among the signals applied from the driving control unit 140.

The memory 155 performs data read, write, and erase functions on a plurality of data cells provided therein, under the control of the controller 151, and may be implemented as a typical EEPROM.

The memory 155 includes a plurality of input and output terminals. Examples of the input terminals connected to the output terminals of the controller for determining the sequence mode include an XCEB terminal for selecting a data cell of the memory 155, an XREADB terminal to which a data read control signal is applied, an XERASEB terminal to which a data erase control signal is applied, a WRITEB terminal to which a data write control signal is applied, an XA terminal for designating the address of the data cell, and an XDIN terminal for receiving a data value, and an example of the output terminal D_out, which is an output terminal of driving voltage data of the display panel.

The sequence mode of the memory 155 is determined in accordance with the control signals input into the above-mentioned terminals, and examples of the sequence mode determined in accordance with the control signals are as shown in the following Table 1.

TABLE 1

| | Mode | | | |
|---|---|---|---|---|
| Name of Terminal | Standby mode | READ mode | WRITE mode | ERASE mode |
| EXVPP | VDD | VDD | VEXVPP | VEXVPP |
| XCEB | High | Low | Low | Low |
| XREADB | High | Low | High | High |
| XERASEB | High | High | High | Low |
| XWRITEB | High | High | Low | High |
| XA | High or Low | Address in | Address in | X |
| XDIN | High or Low | High or low | Data in | X |

Referring to the above Table 1, the standby mode, data read mode, data write mode, and erase mode are determined in accordance with the signals input into the terminals of the memory 155.

Especially, the erase mode is a mode for erasing data stored in a data cell. The XREADB terminal and the XWRITEB terminal switch to the erase mode when they are applied with a high-level voltage.

Therefore, when mounting the power supply control unit 150 on a substrate after writing data in the memory 155, the XWRITEB terminal may be biased with a low voltage or grounded (GND) so that the memory is set not to switch to the erase mode.

The power supply control unit 150 is mounted in a typical SMT method on a substrate electrically connected to the display panel, along with the scan driving unit, the data driving unit, and the driving control unit 140. This applies stress to the memory 150, thus causing malfunctioning. More specifically, the above-described power supply control unit 150 is mounted in a typical SMT process on a predetermined substrate electrically connected to the display panel, and this SMT process is a process in which a cream solder is applied onto the top of a circuit substrate, the power supply control unit 150 involved is mounted in the region applied with cream solder, and then the power supply control unit 150 and the substrate are electrically connected together by applying pressure and heat. At this point, stress is applied to each pin of the memory included in the power supply control unit 150.

Due to such stress, a high-level voltage is applied to the XWRITEB terminal, and hence abnormal voltages may be applied to data cells in the memory 155 storing the EXVPP values which cause the data stored in a data cell to change or be erased. Accordingly, an output signal EXVPP of a part of the memory 155 may cause an abnormal driving voltage VDDEL (e.g., 14V) to be output instead of the nominal driving voltage (e.g., 8.75V).

Consequently, one example embodiment is characterized in that the protector 158 is attached to the XWRITEB terminal of the memory 155 to prevent an abnormal voltage caused by stress applied to that terminal and allow only a normal voltage to pass.

The protector 158 is electrically connected between the output terminal of the controller 151 and the XWRITEB terminal of the memory 155, and upon receipt of an XWRITEB voltage of a normal level from the controller 151, applies it to the memory 155 as it is. Also, upon receipt of an abnormal voltage, the protector 158 pulls it down to an XWRITEB' voltage of low or ground level.

Hereinafter, a structure of the protector 158 according to an embodiment of the present invention will be described below with reference to the drawings. In other embodiments, the protector 158 may be coupled to additional or other pins. For example, the protector 158 may be coupled to the XREADB terminal in addition to the XWRITEB terminal or instead of the XWRITEB terminal to prevent entering the ERASE mode.

Figure 5:
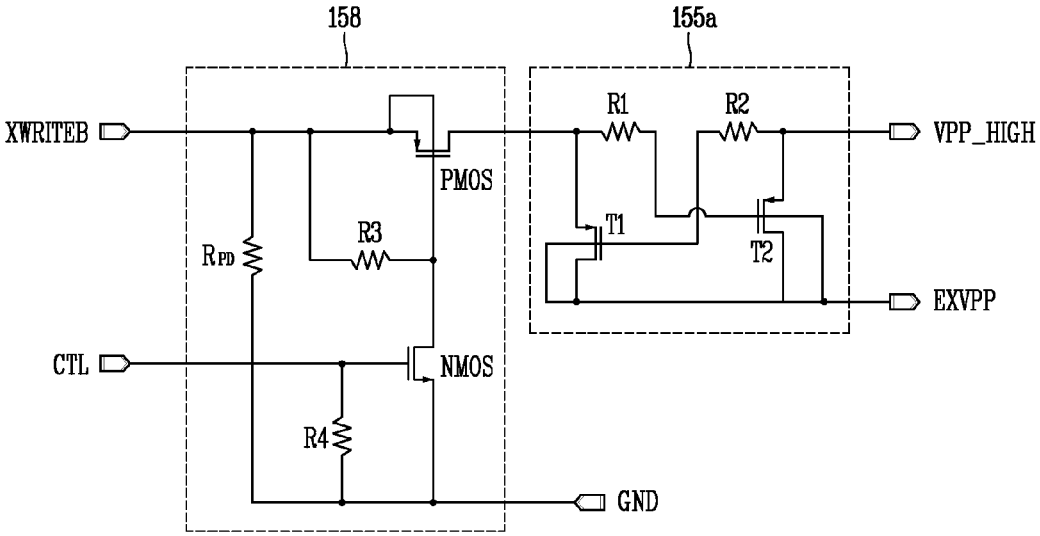
FIG. 5 is an equivalent circuit diagram of the memory and protector of FIG. 4.

FIG. 5 is an equivalent circuit diagram of a part of the memory and protector of FIG. 4.

As shown therein, the memory 155*a* according to the embodiment of the present invention is a typical EEPROM, which is equivalent to a first transistor T1 whose source is connected to a first input terminal connected to an external controller (not shown), whose gate is connected to a second resistor R2, and whose drain is connected to an output terminal, and a second transistor T2 whose source is connected to a second input terminal connected to the external controller, whose gate is connected to a first resistor R1, and whose drain is connected to the output terminal.

Although not shown, the above-mentioned output terminal is connected to a data storage cell in the EEPROM, and performs read, write, and erase operations on predetermined data by an output voltage.

The driving of the EEPROM with this structure will be explained. When a high-level driving enable signal VPP_HIGH is applied to the second input terminal, and a specific sequence signal, e.g., data write signal XWRITEB, is applied, the first and second transistors T1 and T2 become conductive. Accordingly, the data write signal XWRITEB is provided by a driving output voltage EXVPP to the data cell in the EEPROM through the output terminal, thereby performing read, write, and erase operations on data.

The protector 158 includes a PMOS transistor PMOS whose source is connected to an XWRITEB signal input terminal, whose gate is connected to a drain of an NMOS transistor NMOS, and whose drain is connected to the input terminal of the memory 155*a*, and the NMOS transistor NMOS whose source is connected to the above-mentioned PMOS transistor PMOS, whose gate is connected to an operation control signal input terminal, and whose drain is grounded.

Moreover, the protector 158 includes a third resistor R3 whose ends are respectively connected to the source and gate of the PMOS transistor PMOS, and a fourth resistor R4 whose ends are respectively connected to the source and gate of the NMOs transistor NMOS. In addition, the protector 158 further includes a pull-down resistor RPD provided between the XWRITEB signal input terminal and the ground terminal. The above-mentioned pull-down resistor RPD preferably has a resistance value of approximately 40.

With the above-described structure, if data is written in the memory 155*a*, that is, the driving voltage VDDEL of the display panel is set, a driving control signal CTL is applied from the controller (not shown) at a CTL input terminal. Accordingly, the NMOS transistor NMOS and the PMOS transistor PMOS become sequentially conductive. Therefore, when an XWRITEB signal is input into the XWRITEB input terminal, this signal is defined as a normal voltage and applied to the memory 155*a*.

When mounting the memory 155*a* on a substrate by an SMT process after completing the setting of the memory 155*a*, a driving control signal (CTL) is not applied to the NMOS transistor NMOS to thereby hold the NMOS transistor in the off state. Accordingly, even if an abnormal signal is applied to the XWRITEB' input terminal as stress is generated due to the SMT process, the PMOS transistor PMOS is brought to the off state. Therefore, the abnormal voltage is pulled down to the ground voltage level by the pull-down resistor RPD attached to the same node, and therefore no XWRITEB is applied to the memory 155*a*. As a result, the XWRITEB terminal remains at low level.

With the above-described structure, the protector 158, which is a driving circuit of the flat panel display according to one embodiment of the present invention, pulls down the abnormal voltage applied to the memory when stress is applied thereto due to the SMT process, thereby preventing malfunctioning of the memory.

Besides the SMT process, an unexpected voltage may be externally applied and hence a high-level voltage may be applied to the XWRITEB terminal of the memory, thereby causing malfunctioning of the memory. Hereinafter, a driving circuit of a flat panel display according to another embodiment of the present invention will be described with reference to the drawings.

Figure 6:
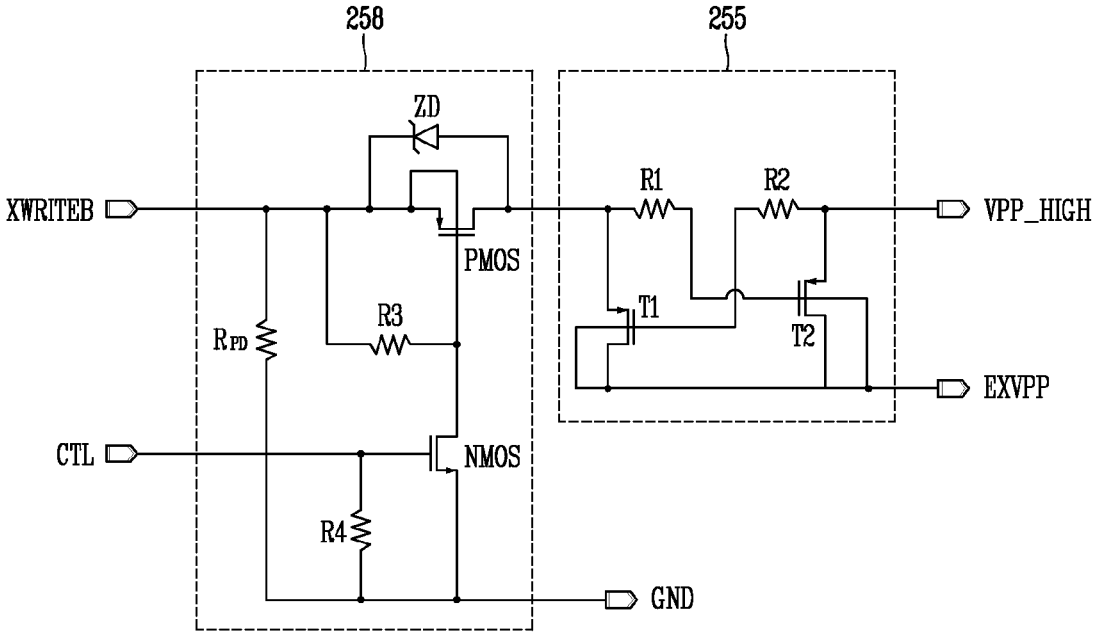
FIG. 6 is an equivalent circuit diagram of a driving circuit of a flat panel display according to another embodiment of the present invention.

FIG. 6 is an equivalent circuit diagram of a driving circuit of a flat panel display according to another embodiment of the present invention.

The memory 255 illustrated in FIG. 6 may be identical to the above-described one of the embodiment illustrated in FIG. 5. However, the protector 258 further includes a zener diode for removing an externally applied voltage.

A structure of the protector 258 will be described in detail. The protector 258 includes a third resistor R3 whose ends are respectively connected to the source and gate of the PMOS transistor PMOS, and a fourth resistor R4 whose ends are respectively connected to the source and gate of the NMOs transistor NMOS. In addition, the protector 258 further includes a pull-down resistor RPD provided between the XWRITEB signal input terminal and the ground terminal.

Moreover, a zener diode ZD is connected to the source and drain of the PMOS transistor PMOS. The zener diode ZD is for removing an abnormal voltage caused by external stress which may be generated at a connecting portion between the protector 258 and the memory 255, and a breakdown voltage of the zener diode ZD is greater than the abnormal voltage and less than a normal voltage.

Accordingly, in the event of an abnormal voltage, the abnormal voltage is pulled down to the ground voltage level by the pull-down resistor RPD, thereby preventing malfunctioning of the memory.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A driving circuit of a flat panel display comprising:

a memory that operates in first and second sequence modes, and is set to the second sequence mode as a control terminal for selecting a sequence mode is grounded and outputs data corresponding to a driving voltage;

a controller whose output terminal is coupled to the control terminal, and which determines the sequence mode of the memory; and a protector that electrically couples the output terminal and the control terminal in the second sequence mode, and prevents the memory from malfunctioning in the first sequence mode as an abnormal voltage is applied to the control terminal by decoupling the output terminal and the control terminal.

2. The driving circuit of claim 1, wherein the first sequence mode is a data erase mode of the memory.

3. The driving circuit of claim 1, wherein the second sequence mode is one selected from the group consisting of a standby mode, a data read mode, and a data write mode of the memory.

4. The driving circuit of claim 1, wherein the protector comprises:

a first switching element whose source is coupled to the output terminal, and whose drain is coupled to the control terminal;

a second switching element whose source is coupled to the first switching element, whose gate is coupled to an operation control signal terminal of the controller, and whose drain is grounded;

a first resistor whose ends are respectively coupled to the source and a gate of the first switching element;

a second resistor whose ends are respectively coupled to the source and the gate of the second switching element; and a pull-down resistor coupled between the output terminal and the ground terminal.

5. The driving circuit of claim 4, wherein the first and second switching elements are a PMOS transistor and an NMOS transistor, respectively.

6. The driving circuit of claim 4, wherein the protector further comprises a zener diode that is coupled in parallel to the first switching element, and whose breakdown voltage is greater than the abnormal voltage.

7. The driving circuit of claim 1, wherein the abnormal voltage is a voltage generated by stress applied to the memory during an SMT process.

8. The driving circuit of claim 1, wherein the driving voltage corresponds to a voltage (VDDEL) for driving an organic light emitting diode.

9. The driving circuit of claim 1, wherein the memory is an EEPROM.

* * * * *